US011594838B2

(12) United States Patent
Little

(10) Patent No.: US 11,594,838 B2
(45) Date of Patent: Feb. 28, 2023

(54) CONNECTOR ASSEMBLY WITH CONNECTOR POSITION ASSURANCE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 1 day.

(21) Appl. No.: 17/241,369

(22) Filed: Apr. 27, 2021

(65) Prior Publication Data

US 2021/0336387 A1 Oct. 28, 2021

Related U.S. Application Data

(60) Provisional application No. 63/016,872, filed on Apr. 28, 2020.

(51) Int. Cl.

| | |
|---|---|
| ***H01R 13/627*** | (2006.01) |
| ***H01R 13/639*** | (2006.01) |
| ***H01R 13/64*** | (2006.01) |

(52) U.S. Cl.

CPC ..... *H01R 13/6272* (2013.01); *H01R 13/639* (2013.01); *H01R 13/64* (2013.01)

(58) Field of Classification Search

CPC ..... H01R 13/6272; H01R 13/6271; H01R 13/6275; H01R 13/639; H01R 13/64; H01R 13/6582; H01R 13/641

See application file for complete search history.

(56) References Cited

U.S. PATENT DOCUMENTS

| | | | | |
|---|---|---|---|---|
| 6,261,115 | B1 * | 7/2001 | Pederson | H01R 13/6272 439/352 |
| 6,261,116 | B1 * | 7/2001 | Ceru | H01R 13/6272 439/352 |
| 6,659,789 | B2 * | 12/2003 | Nagamine | H01R 13/639 439/352 |
| 7,682,181 | B1 * | 3/2010 | Jones, Jr. | H01R 13/6272 439/352 |
| 7,909,638 | B2 * | 3/2011 | Seo | H01R 13/6272 439/352 |
| 8,016,606 | B1 * | 9/2011 | Kwan | H01R 13/641 439/352 |

(Continued)

*Primary Examiner* — Thanh Tam T Le

(74) *Attorney, Agent, or Firm* — Ming Chieh Chang

(57) ABSTRACT

A connector position assurance device (CPA) cooperated with a plug connector to ensure a latch of the plug connector located in a releasing state or a blocked state, includes a base including a downwardly deflectable center arm and a pair of sidewardly deflectable side arms enclosing the center arm in a transverse direction. The bottom surface of the center arm have an engagement protrusion, each side arms have an engagement protrusion which protruding in a transverse direction. The CPA is maintained in a front blocked position or a rear releasing position in the connector to ensure the latch blocked or released.

8 Claims, 23 Drawing Sheets

(56) References Cited

U.S. PATENT DOCUMENTS

| | | | | |
|---|---|---|---|---|
| 8,747,146 | B2 * | 6/2014 | Brown | H01R 13/639 439/489 |
| 8,827,729 | B2 * | 9/2014 | Gunreben | H01R 13/70 439/188 |
| 9,281,619 | B2 * | 3/2016 | Morello | H01R 13/639 |
| 9,300,084 | B2 * | 3/2016 | Wimmer | H01R 13/639 |
| 9,350,116 | B1 * | 5/2016 | Morello | H01R 13/633 |
| 10,038,278 | B2 * | 7/2018 | Lane | H01R 13/6272 |
| 10,305,221 | B2 * | 5/2019 | Ohfuku | H01R 13/641 |
| 10,340,632 | B1 * | 7/2019 | Rangi | H01R 13/631 |
| 10,404,012 | B1 * | 9/2019 | Stoyanov | H01R 13/641 |
| 10,714,869 | B2 * | 7/2020 | Endo | H01R 13/6273 |
| 10,784,625 | B2 * | 9/2020 | Narama | H01R 13/641 |
| 10,811,819 | B2 * | 10/2020 | Azad | H01R 13/64 |

* cited by examiner

CONNECTOR ASSEMBLY WITH CONNECTOR POSITION ASSURANCE

CROSS REFERENCE TO RELATED APPLICATIONS

This application claims the benefit of, and priority to, U.S. Provisional Patent Application No. 63/016,872, filed Apr. 28, 2020, the content of which is incorporated entirely herein by reference.

BACKGROUND OF THE INVENTION

1. Field of the Invention

The present invention relates generally to an electrical connector assembly with the plug connector and the receptacle connector mated with and locked to each other wherein the plug connector is equipped with a moveable assuring device for avoiding inadvertent unlocking.

2. Description of Related Arts

As disclosed in provisional application Ser. No. 62/946,945 filed on Dec. 11, 2019, an electrical connector includes a receptacle connector mounted to the printed circuit board and mateable with a plug connector connected with a cable wherein the plug connector is equipped with a deflectable/resilient latch for locking to a locking stand formed on the receptacle connector.

Anyhow, there is no proper protection for preventing excessive outward deflection of the resilient latch that may improperly break the latch when the plug connector is in a free/un-mated state, and/or inadvertent inwardly deflection of the resilient latch that may result in unlatching when mated with the receptacle connector. A plug connector equipped with the protection structures for preventing the aforementioned situations is desired.

SUMMARY OF THE INVENTION

To achieve the above object, a connector position assurance (CPA), cooperated with a plug connector to ensure a latch of the plug connector being in a releasing state or a blocked state, includes a base including a downwardly deflectable center arm and a pair of sidewardly deflectable side arms enclosing the center arm in a transverse direction. The bottom surface of the center arm have an engagement protrusion and each side arm has an engagement protrusion protruding in a transverse direction. The CPA is maintained in a front blocked position or a rear releasing position in the connector to ensure that the latch is blocked or released.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
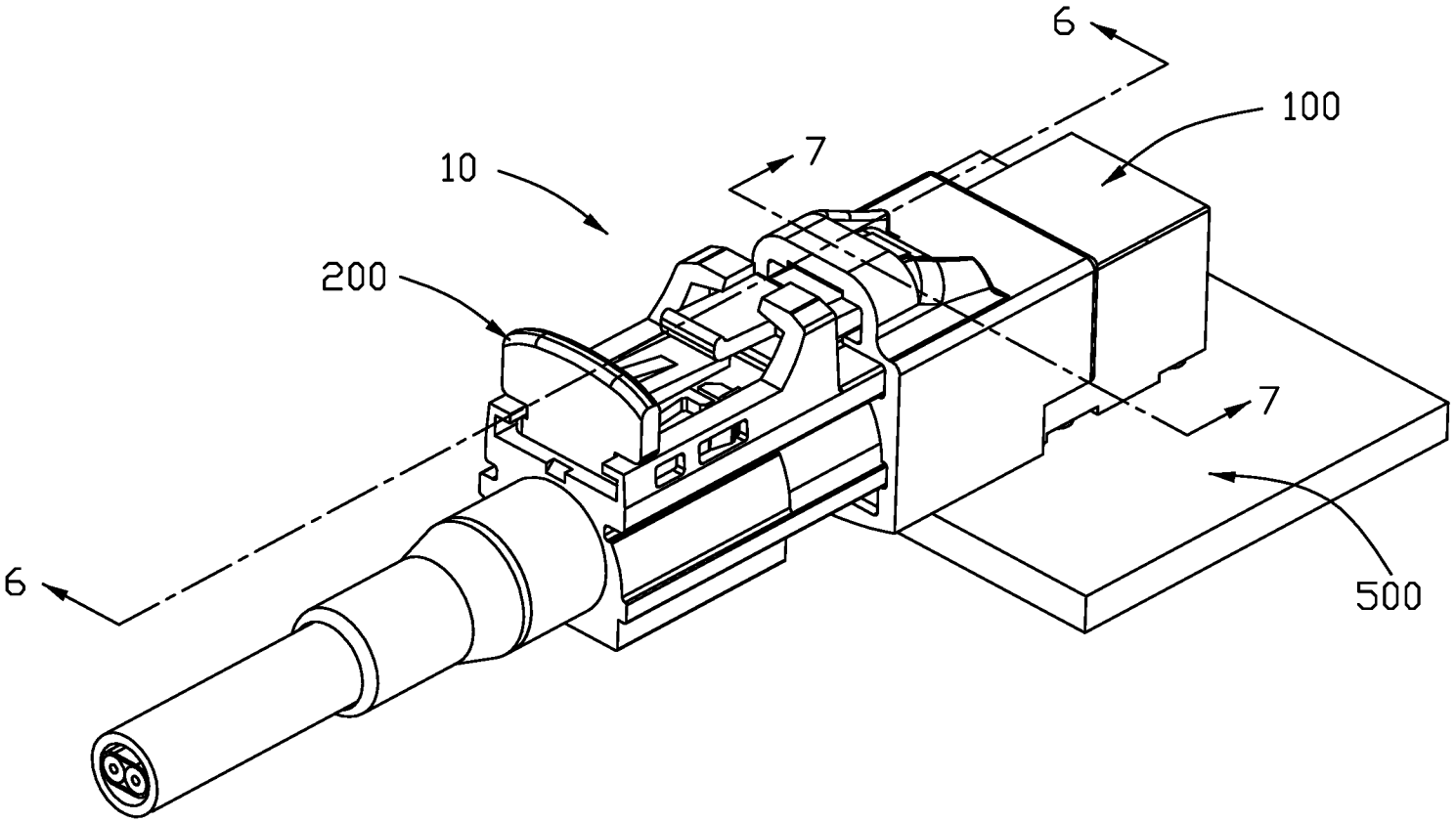
FIG. 1 is a perspective view of a connector assembly including a receptacle connector and a plug connected mated with each other according to a preferred embodiment of the present invention.
Figure 2:
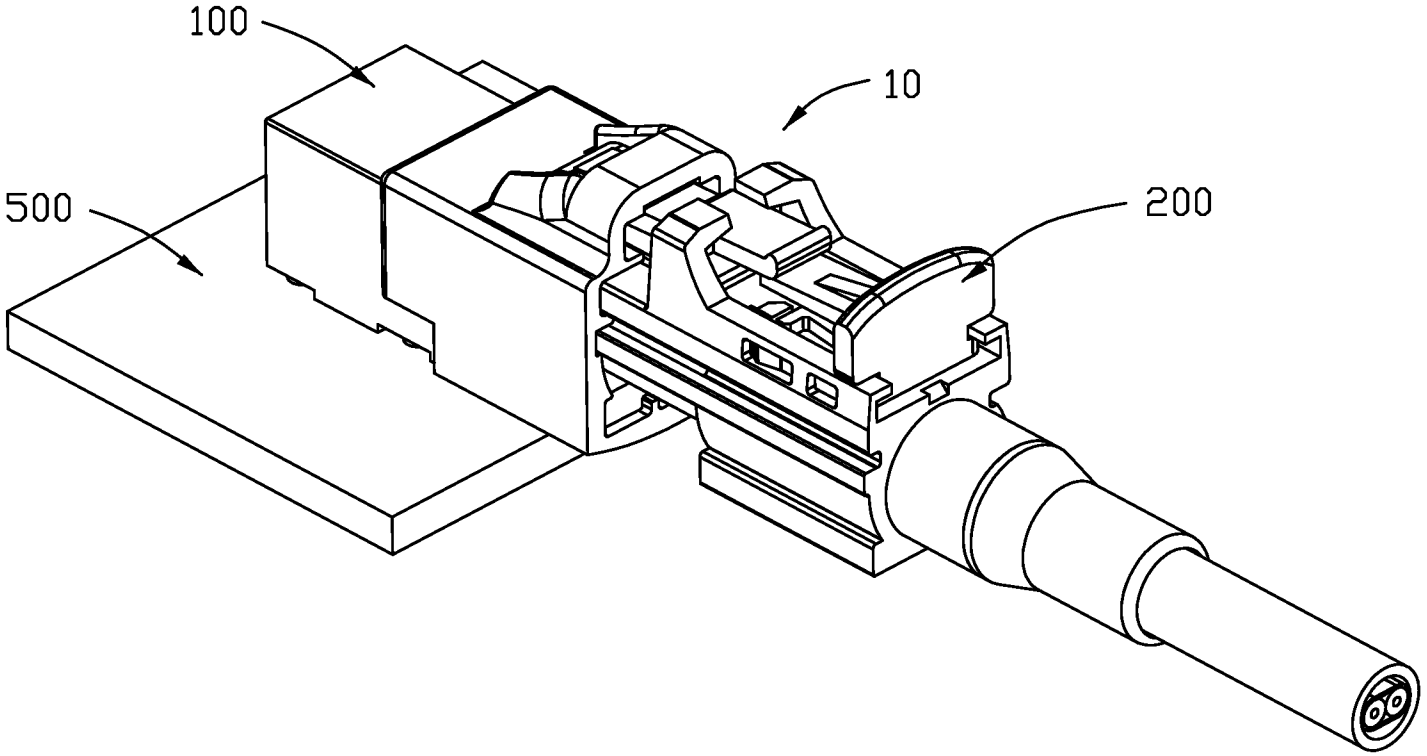
FIG. 2 is another perspective view of the connector assembly of FIG. 1.
Figure 3:
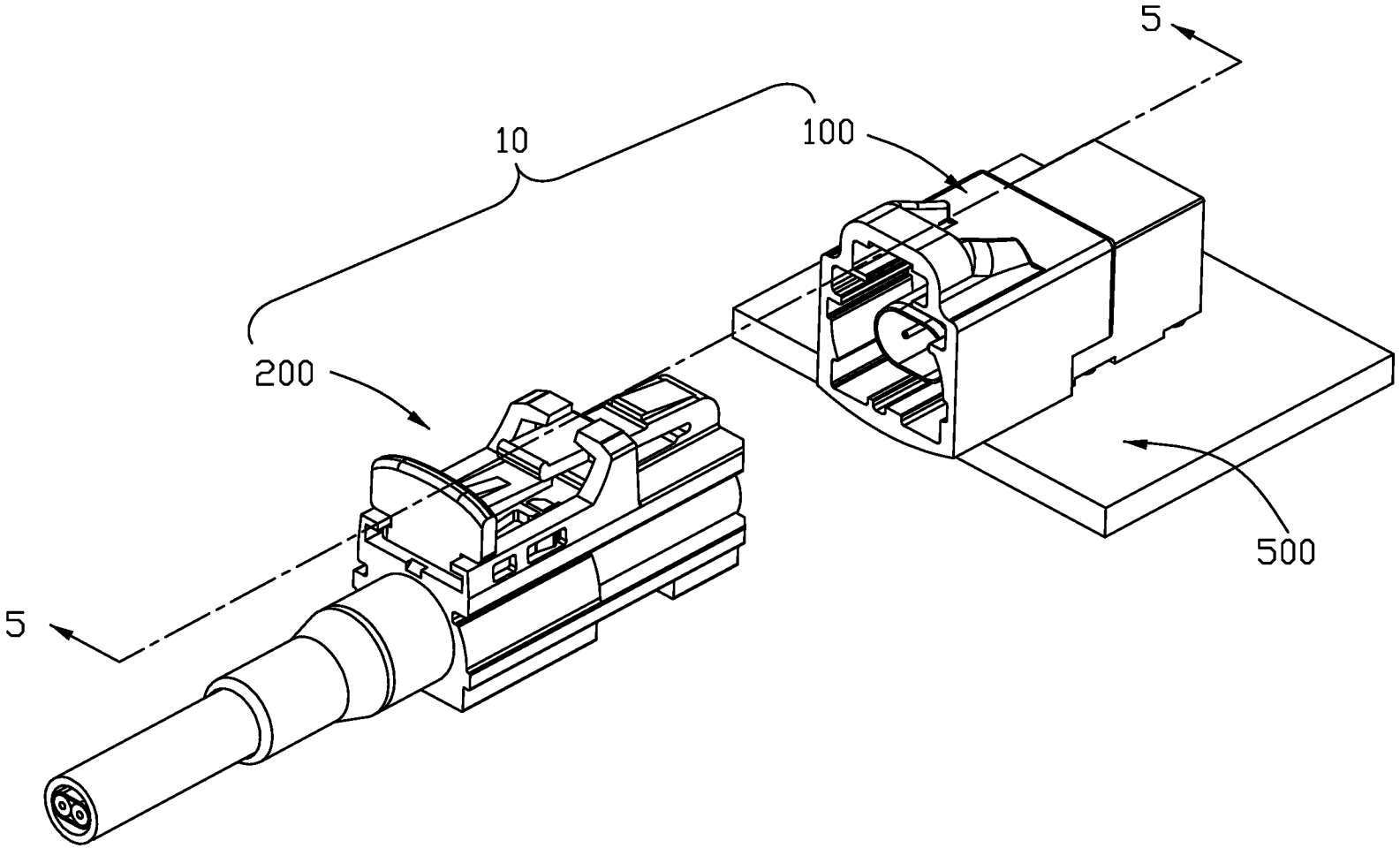
FIG. 3 is a perspective view of the connector assembly of FIG. 1 wherein the plug connector and the receptacle connector are separated from each other.
Figure 4:
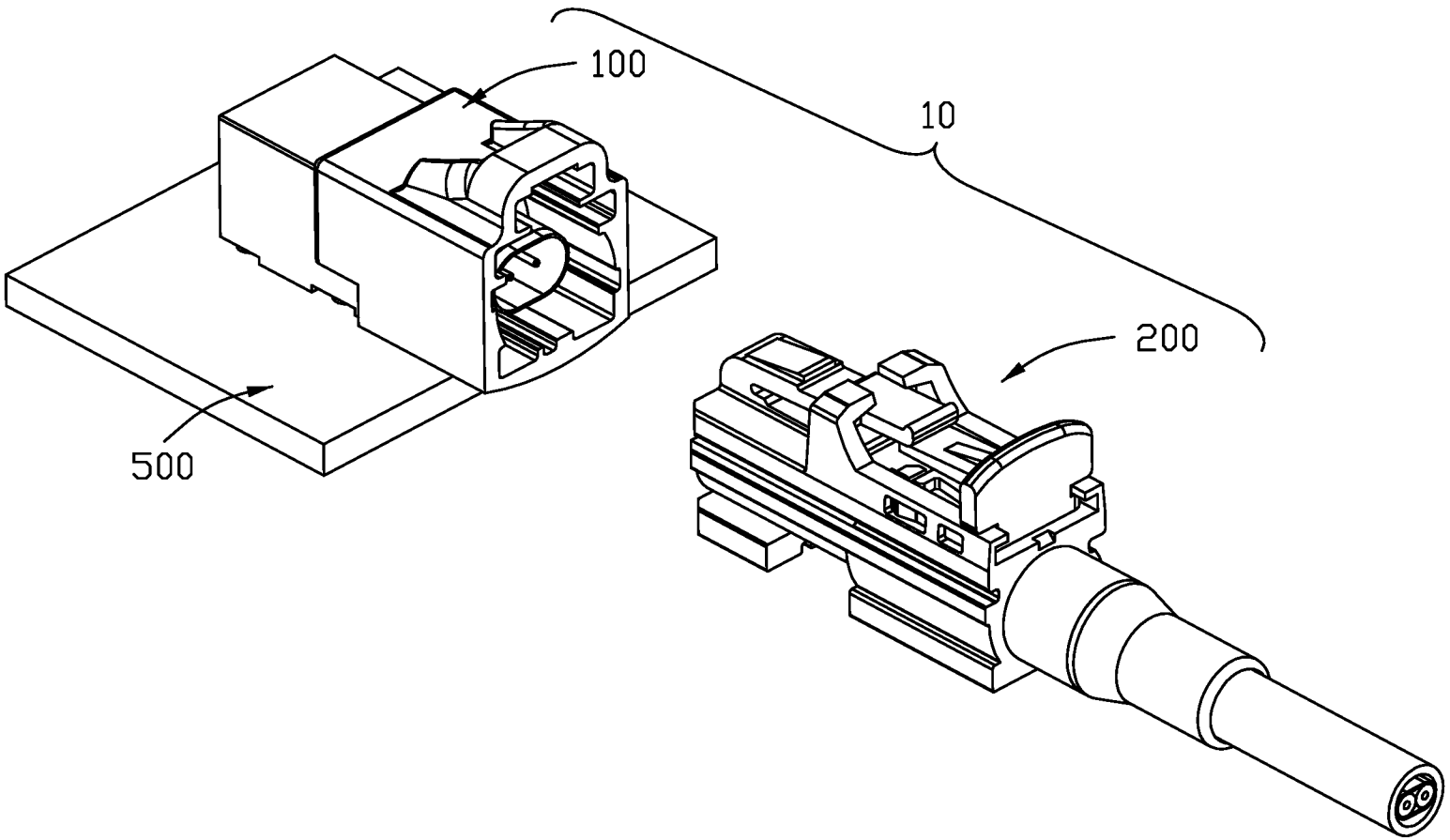
FIG. 4 is another perspective view of the connector assembly of FIG. 3.
Figure 5:
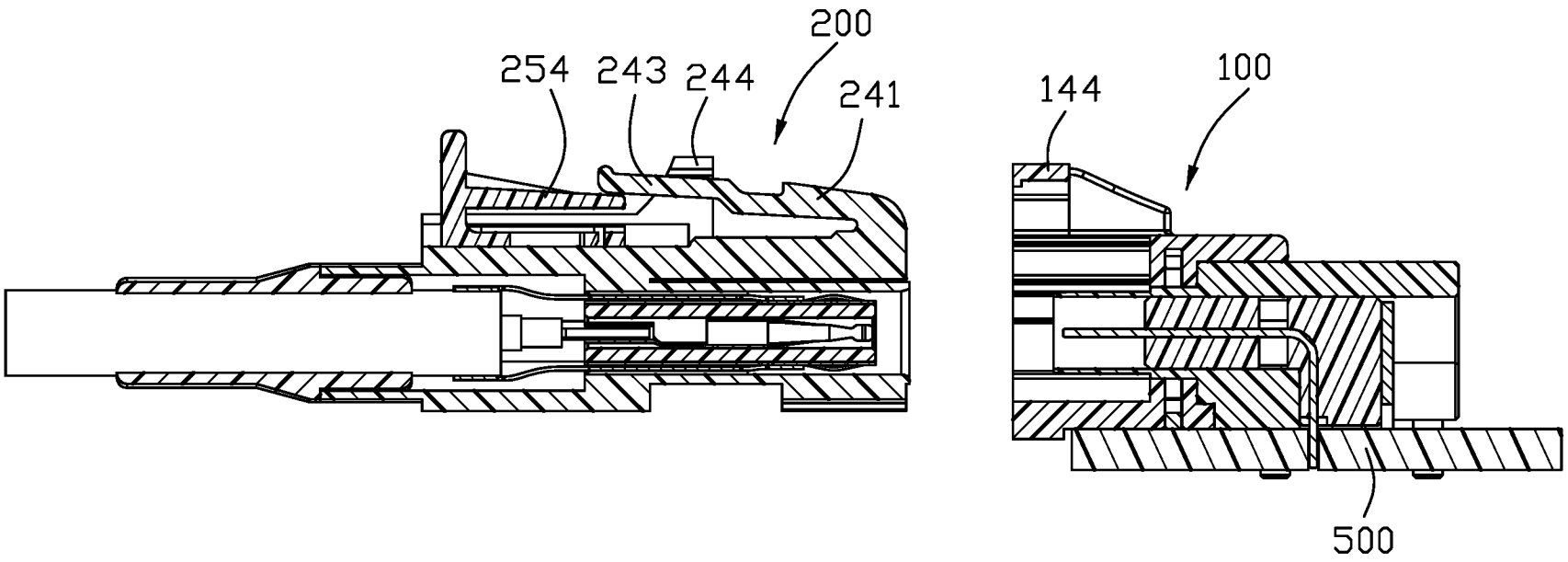
FIG. 5 is a cross-sectional view of the connector assembly of FIG. 3.
Figure 6:
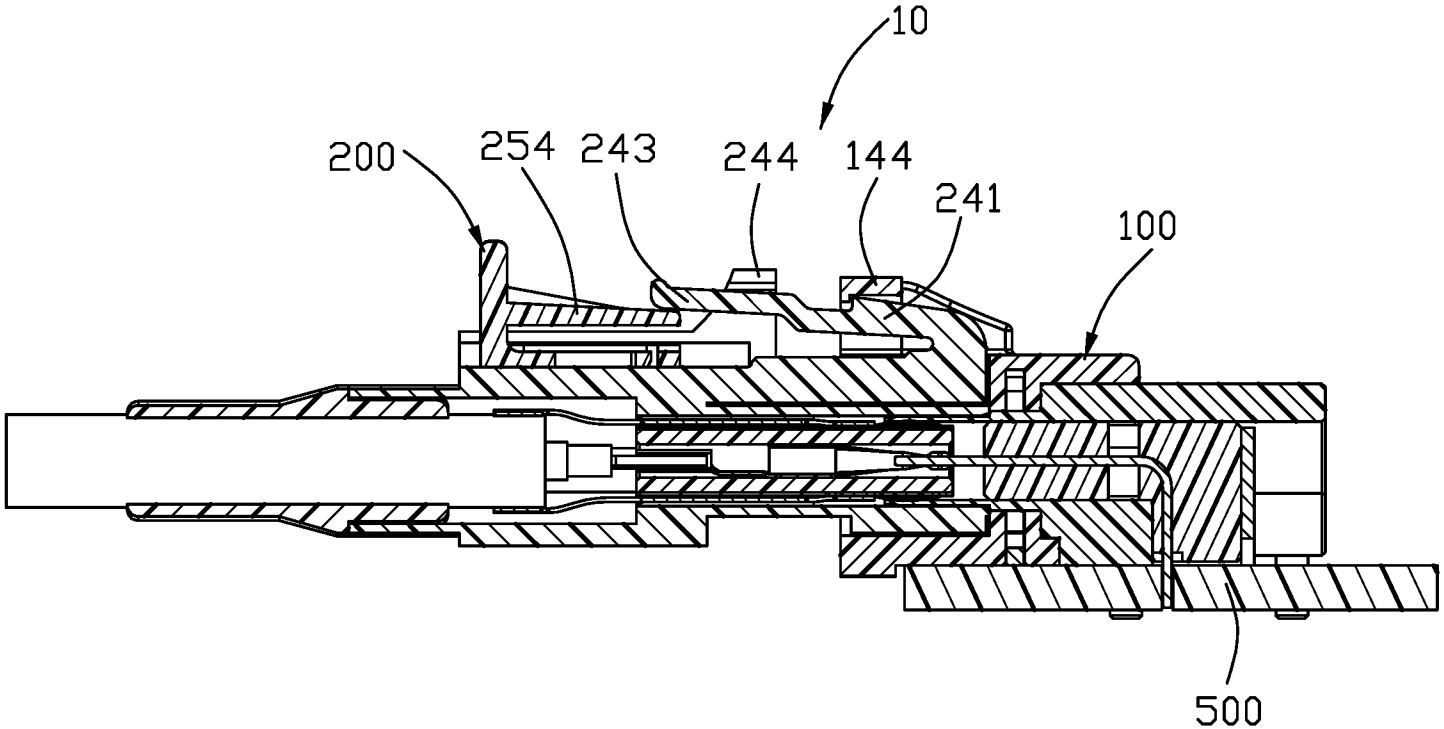
FIG. 6 is a cross-sectional view of the connector assembly of FIG. 1.
Figure 7:
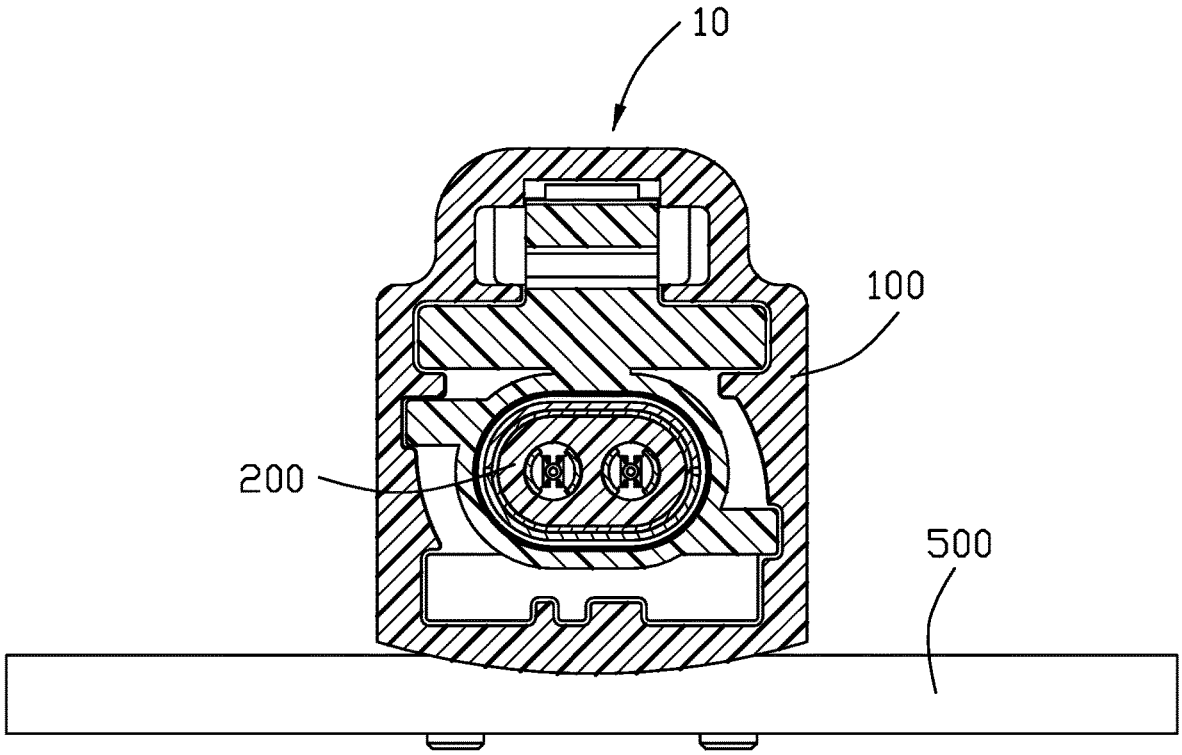
FIG. 7 is another cross-sectional view of the connector assembly of FIG. 1.
Figure 8:
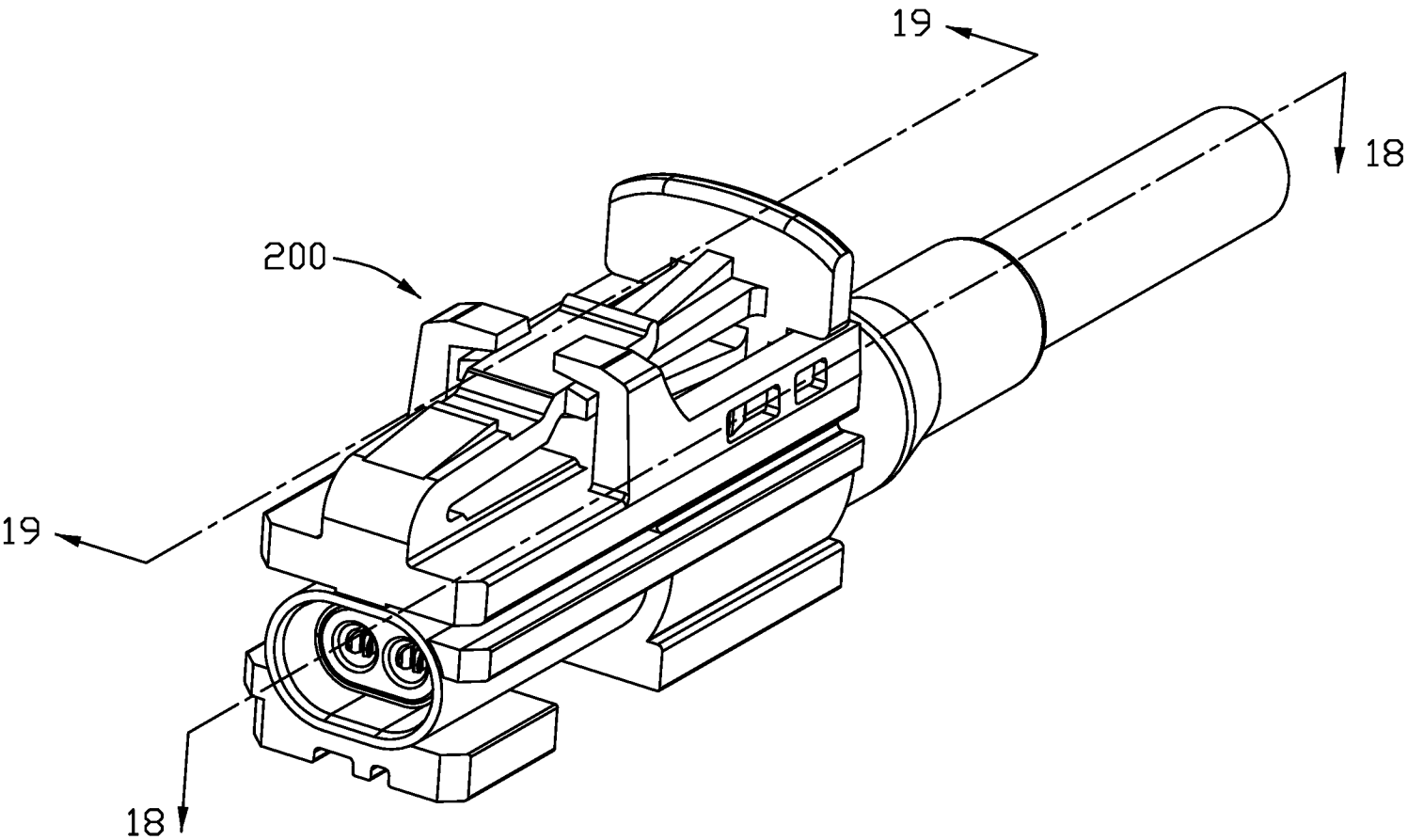
FIG. 8 is a perspective view of the plug connector of the connector assembly of FIG. 1.
Figure 9:
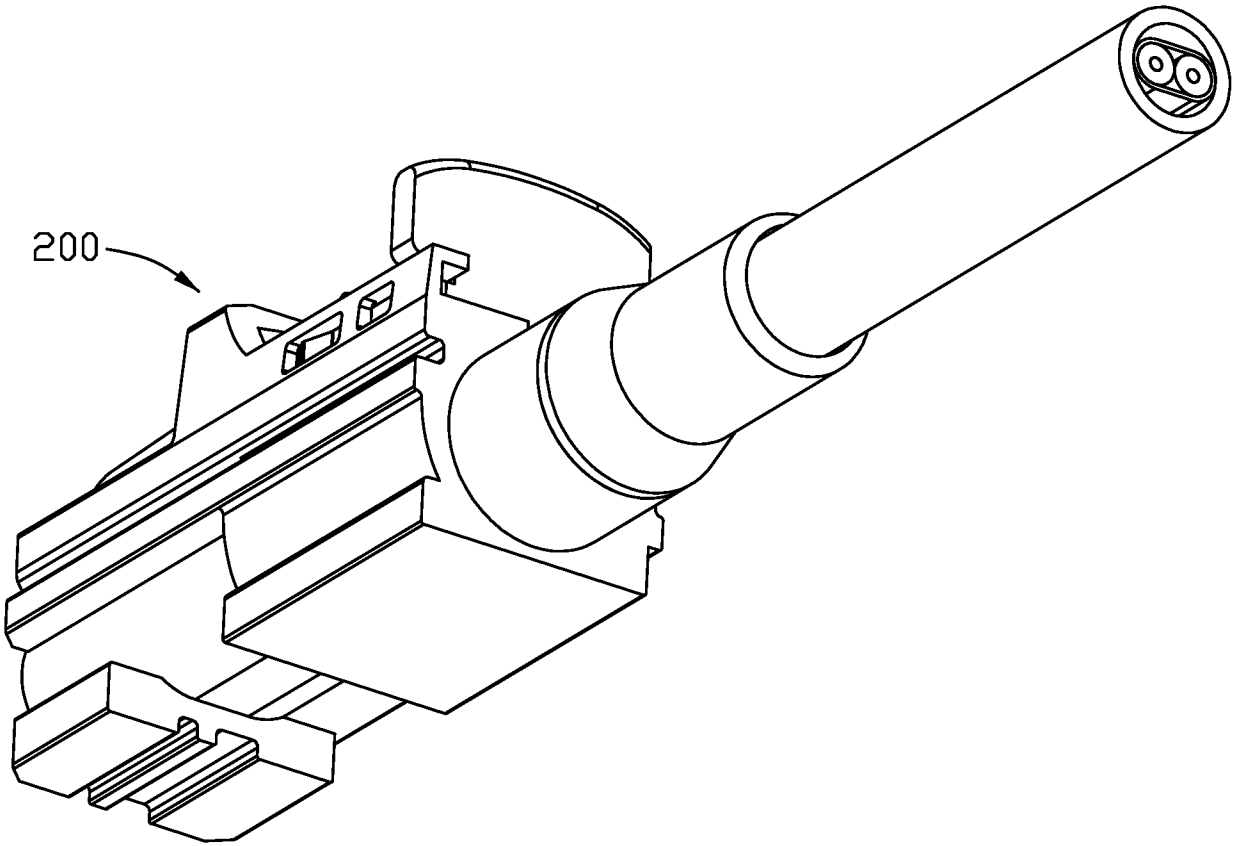
FIG. 9 is another perspective view of plug connector of the connector assembly of FIG. 8.
Figure 10:
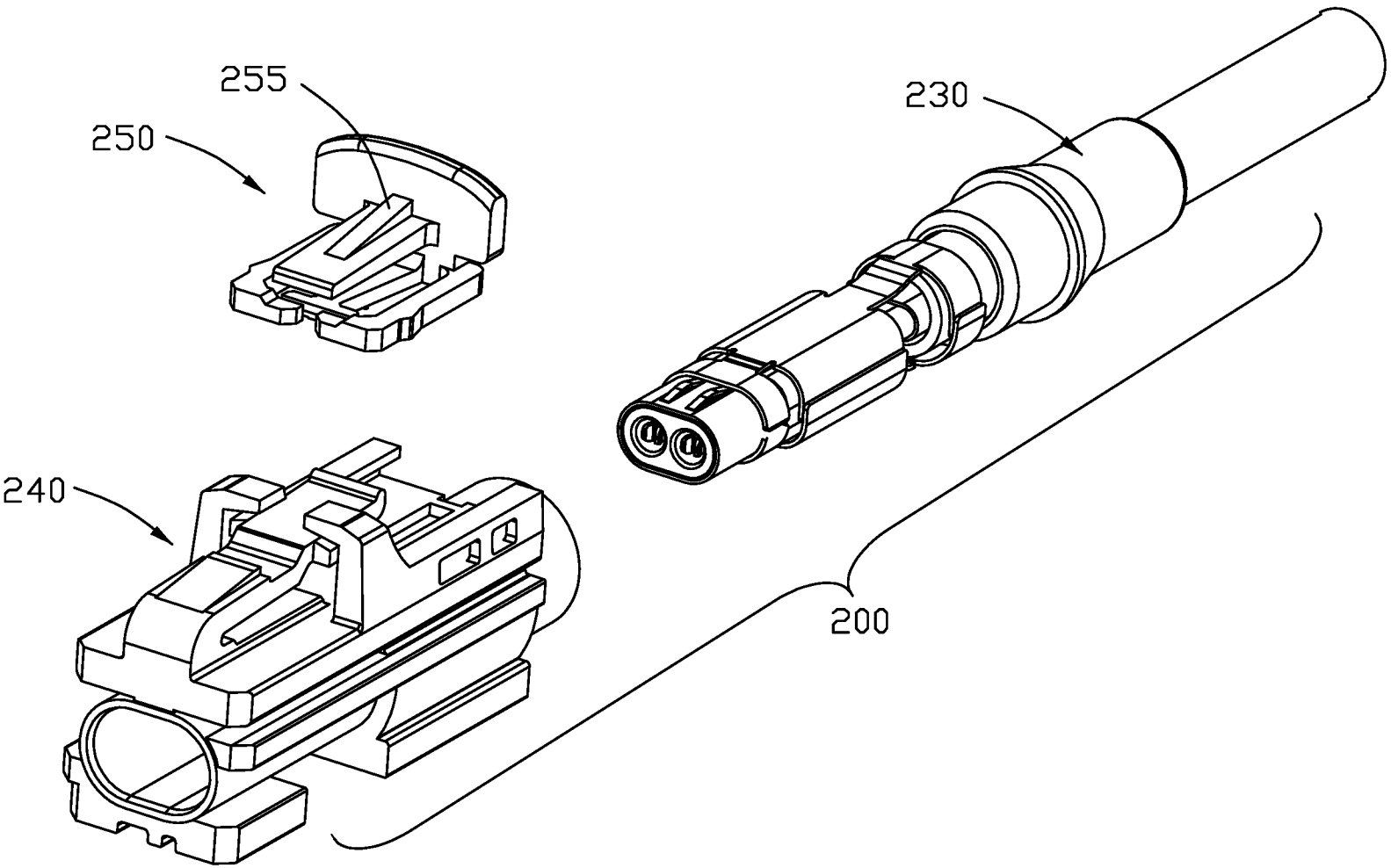
FIG. 10 is an exploded perspective view of the plug connector of the connector assembly of FIG. 8.
Figure 11:
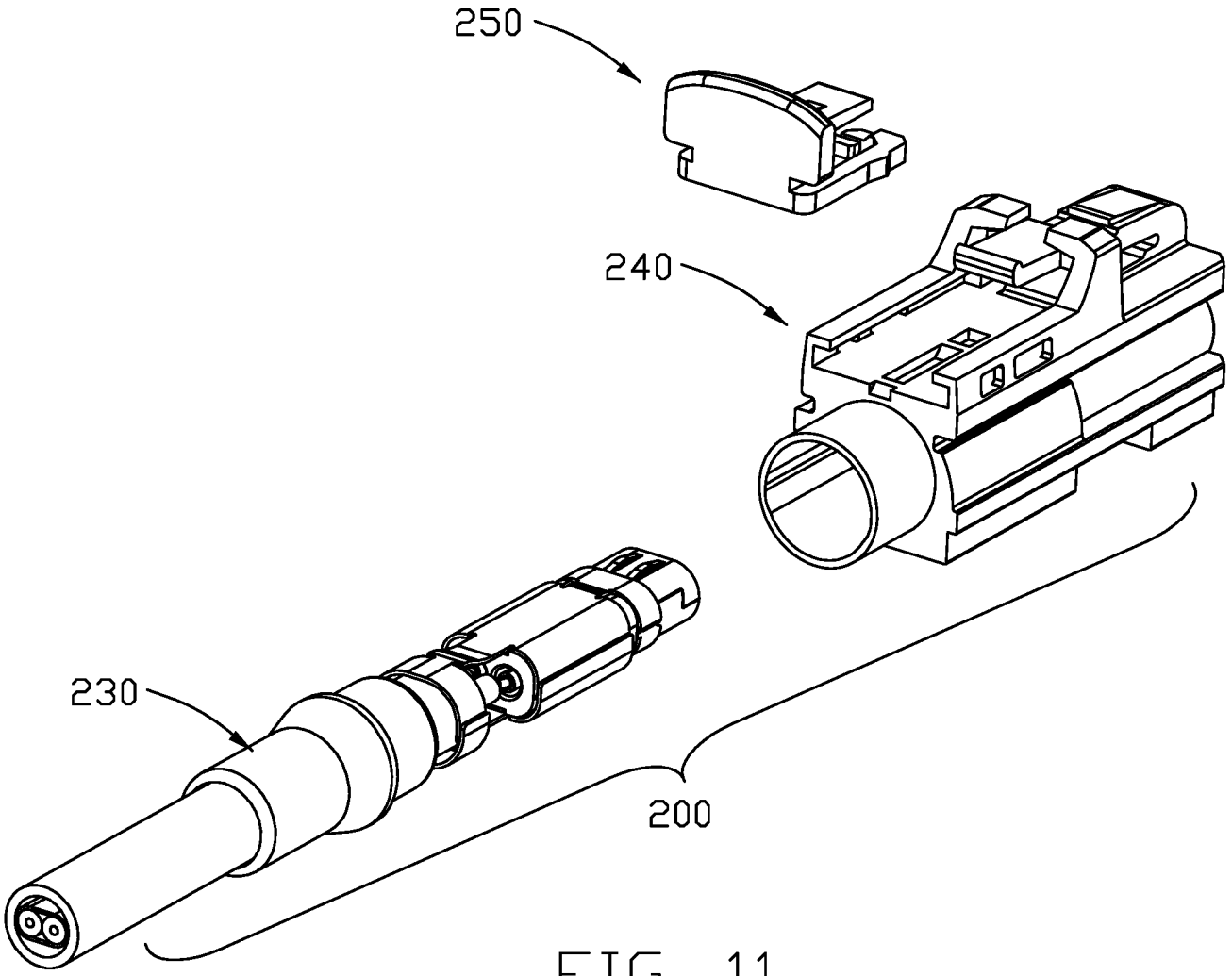
FIG. 11 is another exploded perspective view of the plug connector of the connector assembly of FIG. 10.
Figure 12:
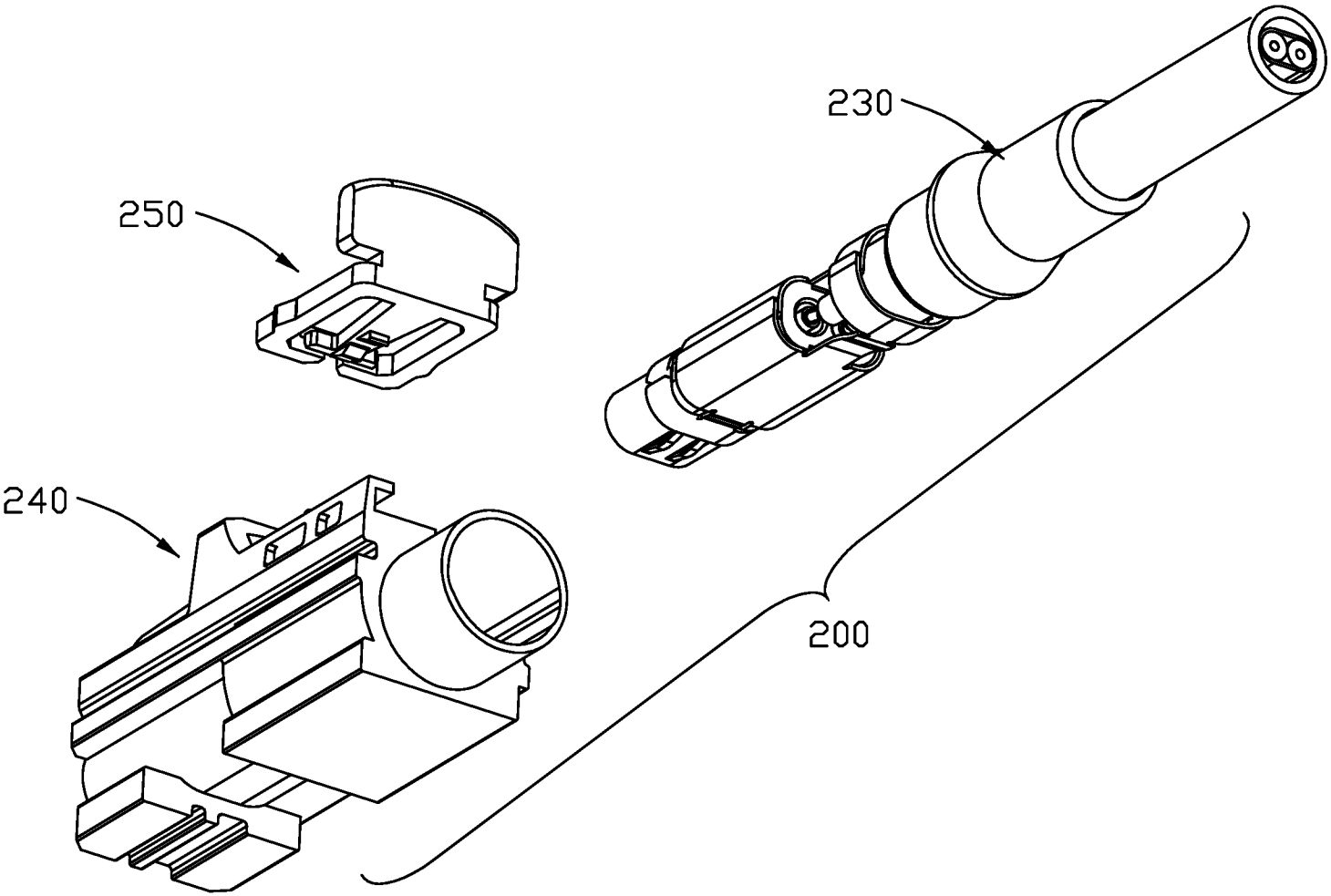
FIG. 12 is another explode perspective view of the plug connector of the connector assembly of FIG. 10.
Figure 13:
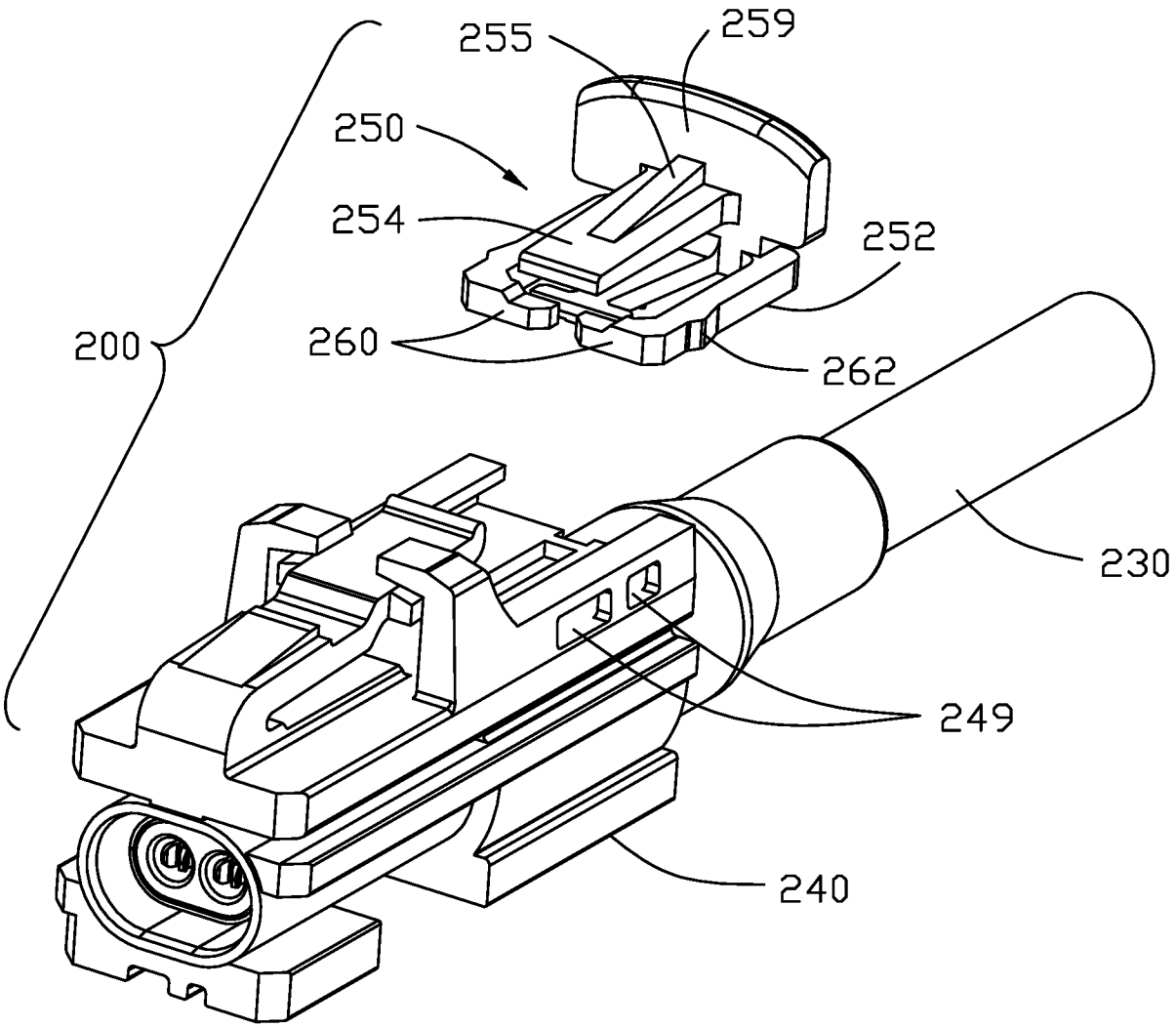
FIG. 13 is an exploded perspective view of the plug connector of the connector assembly of FIG. 8 wherein the contact module is received within the outer cover.
Figure 14:
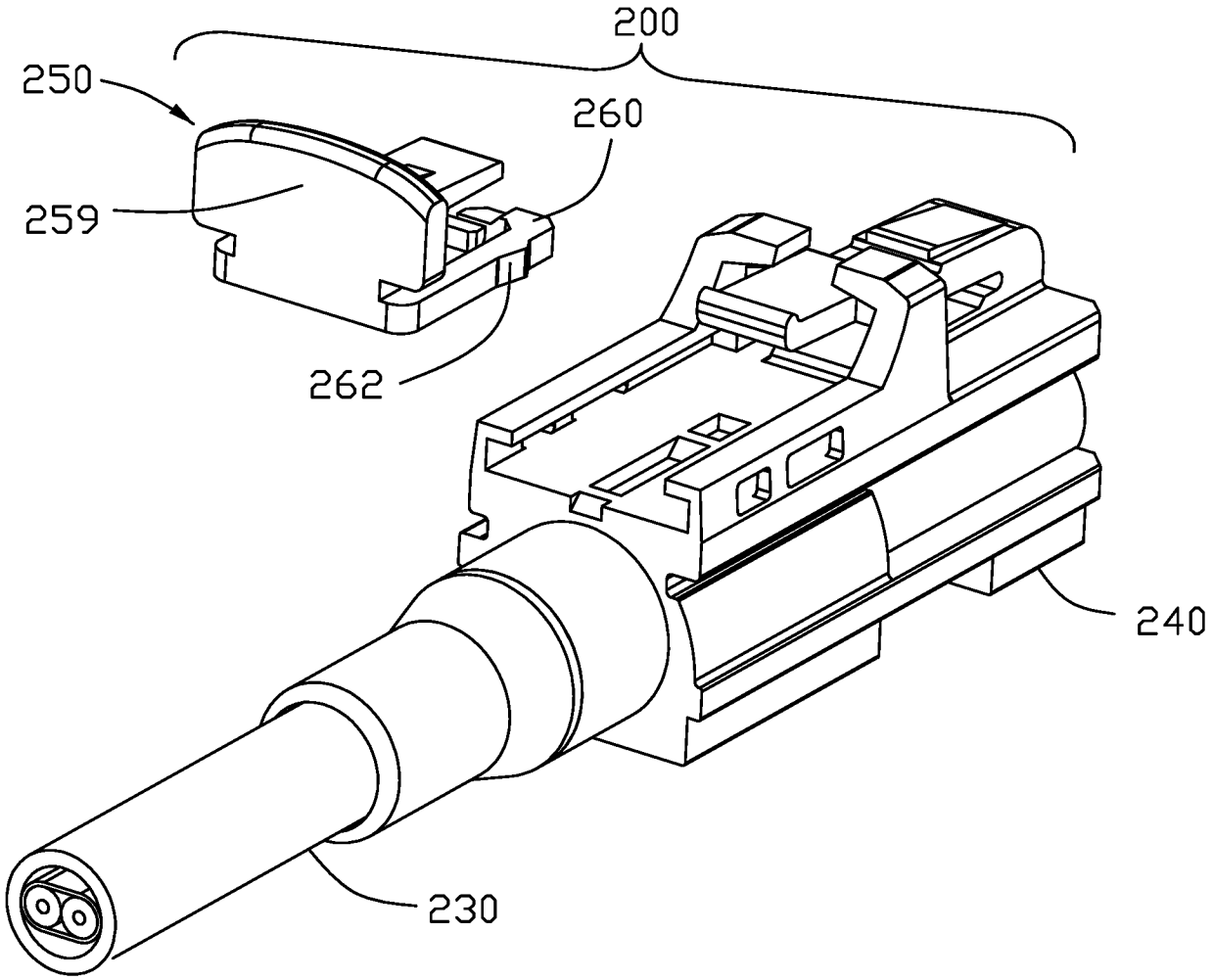
FIG. 14 is another exploded perspective view of the plug connector of the connector assembly of FIG. 13.
Figure 15:
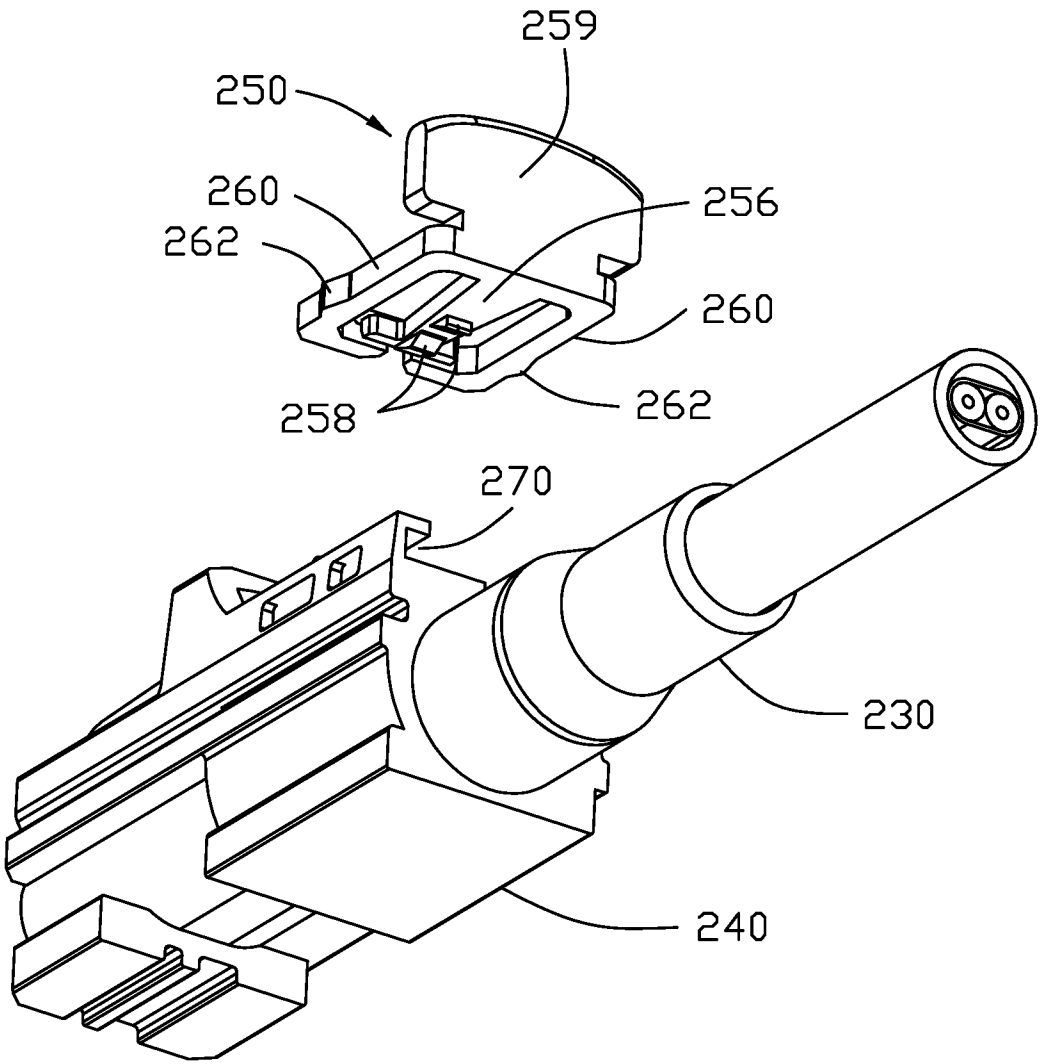
FIG. 15 is another exploded perspective view of the plug connector of the connector assembly of FIG. 13.
Figure 16:
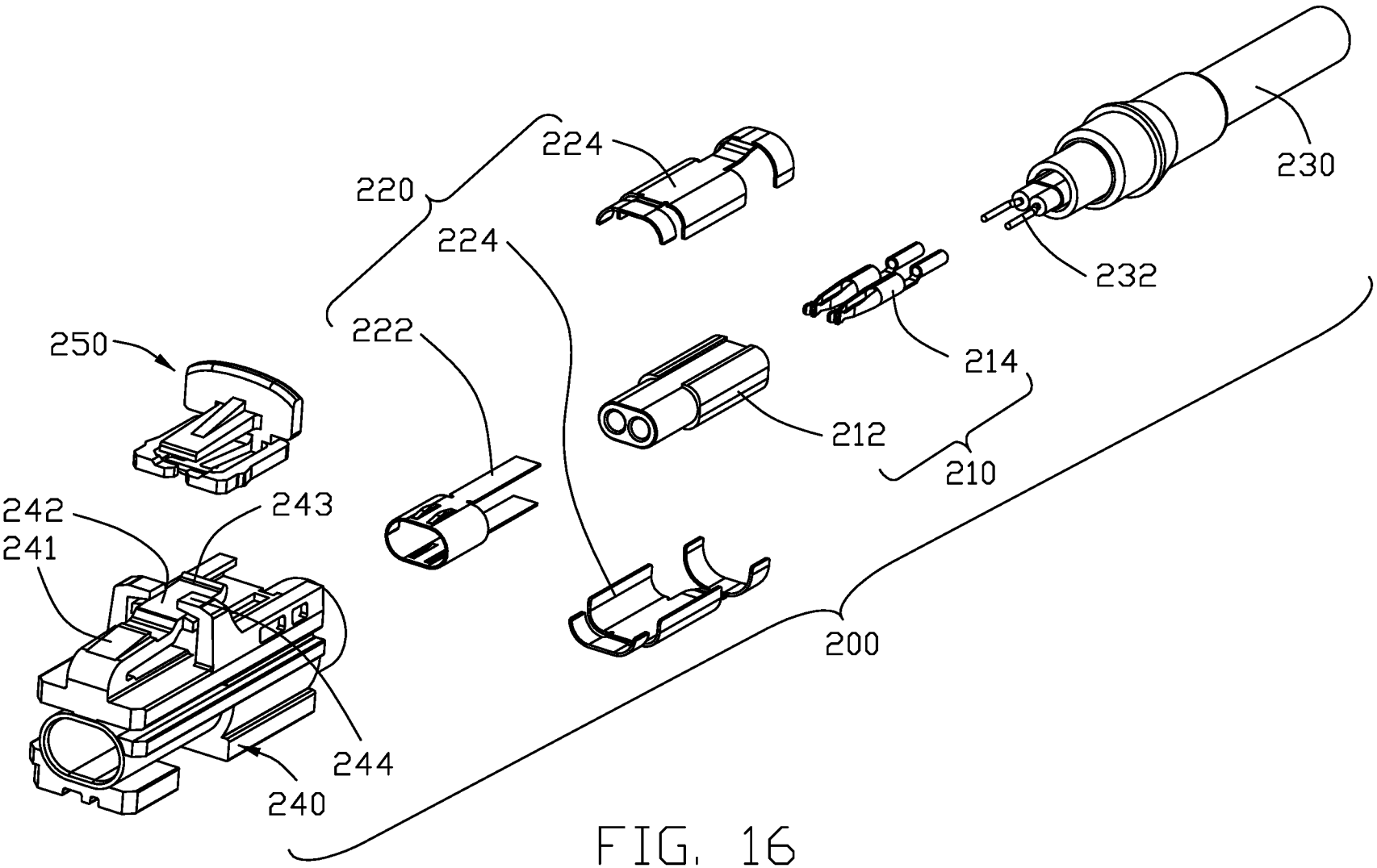
FIG. 16 is a relatively detailed exploded perspective view of the plug connector of the connector assembly of FIG. 13.
Figure 17:
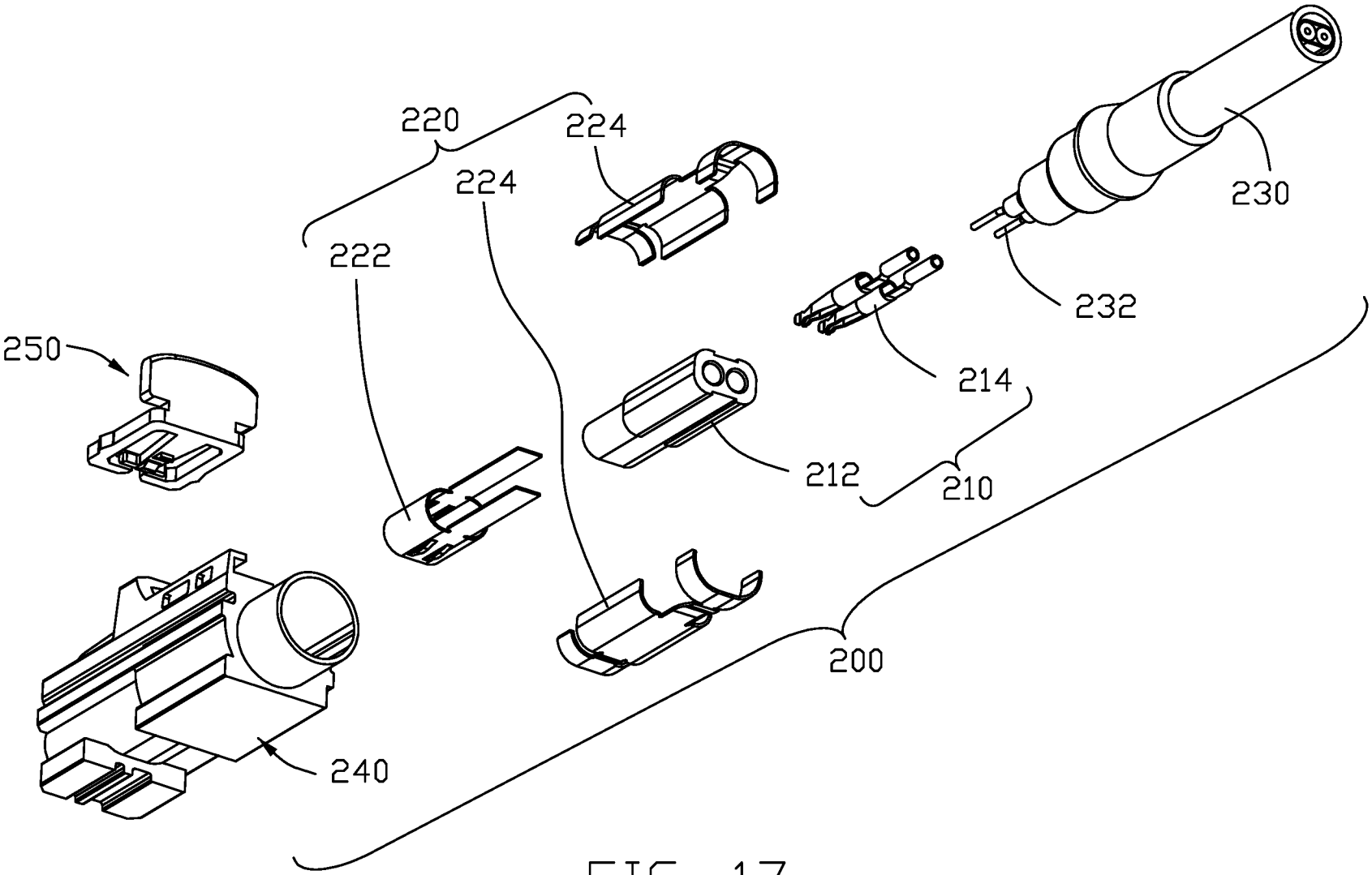
FIG. 17 is another exploded perspective view of the plug connector of the connector assembly of FIG. 16.
Figure 18:
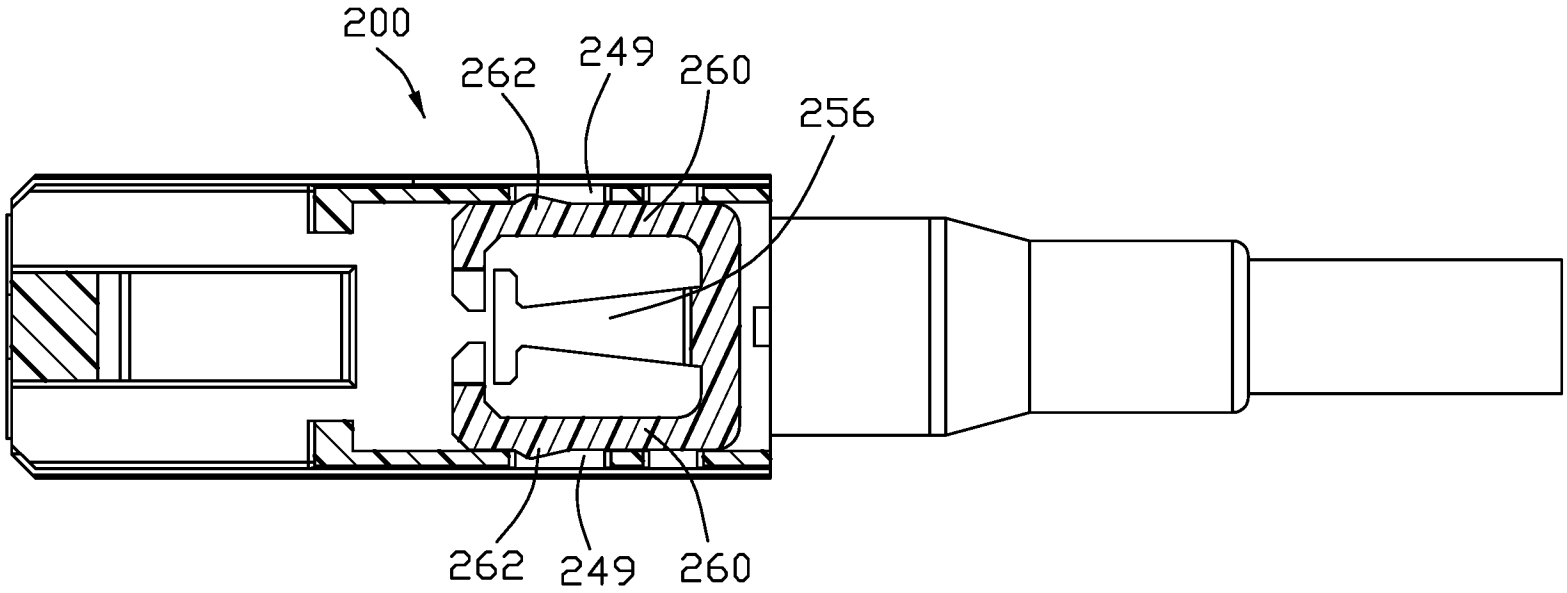
FIG. 18 is a cross-sectional view of the plug connector of the connector assembly of FIG. 8.
Figure 19:
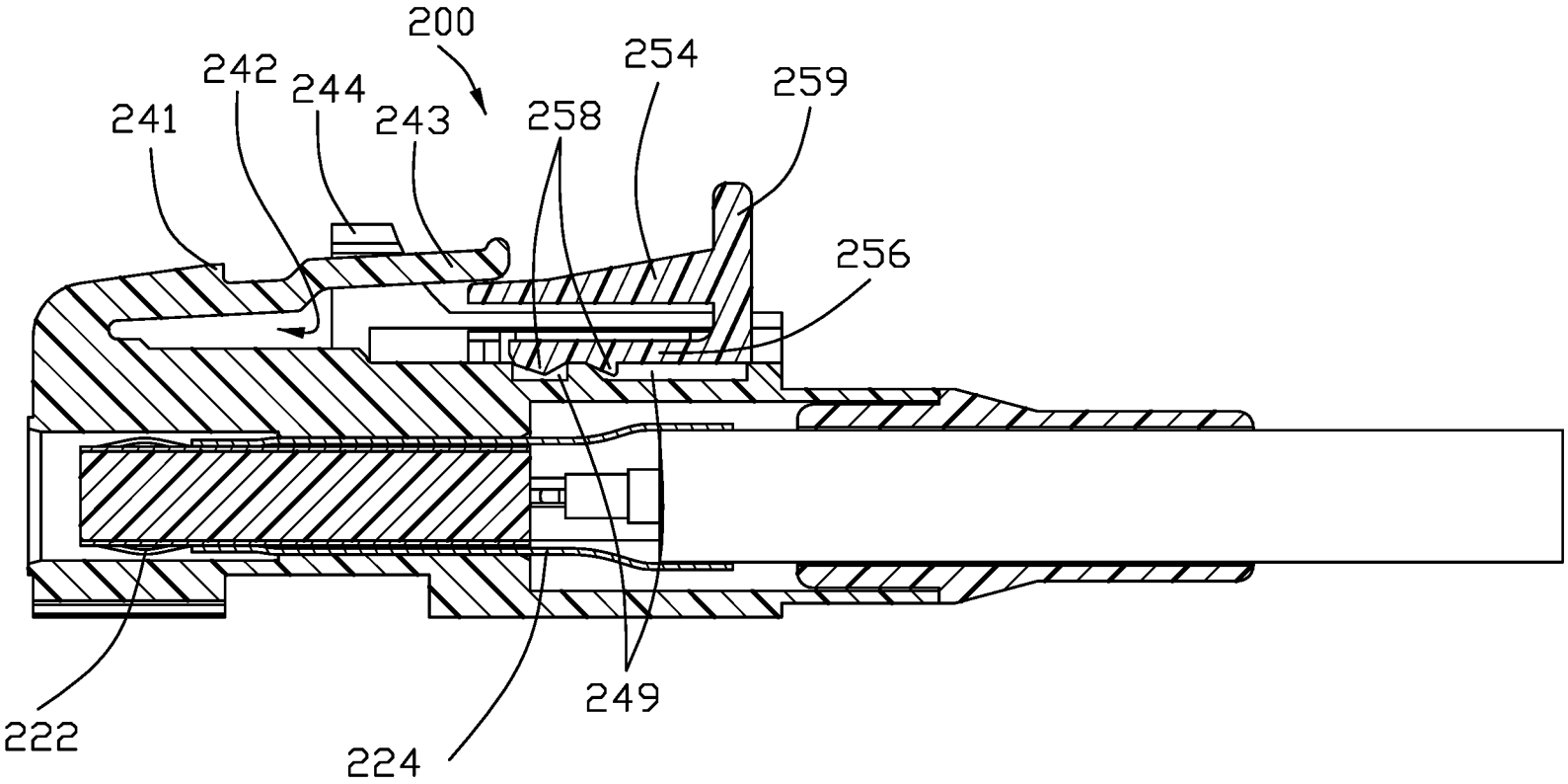
FIG. 19 is another cross-sectional view of the plug connector of the connector assembly of FIG. 8.
Figure 20:
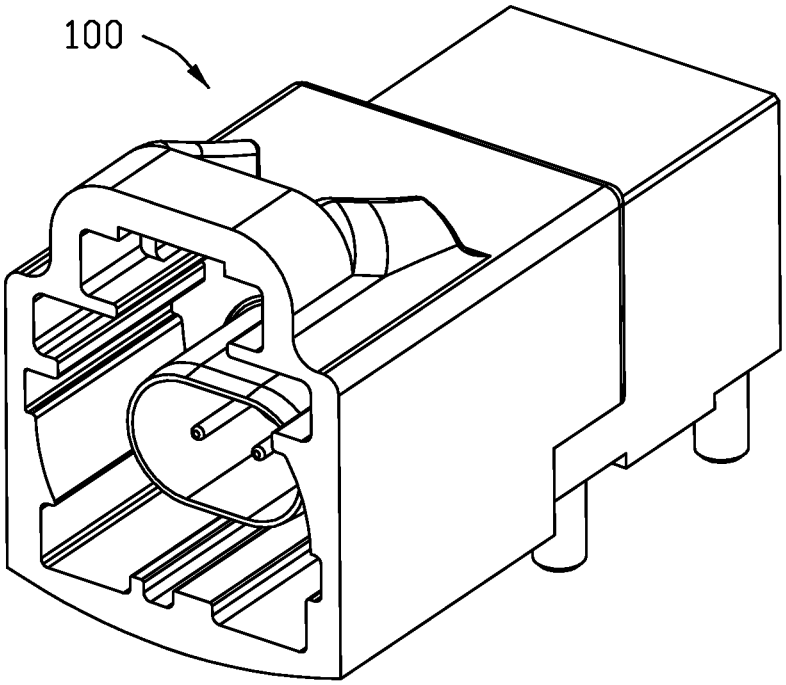
FIG. 20 is a perspective view of the receptacle connector of the connector assembly of FIG. 11.
Figure 21:
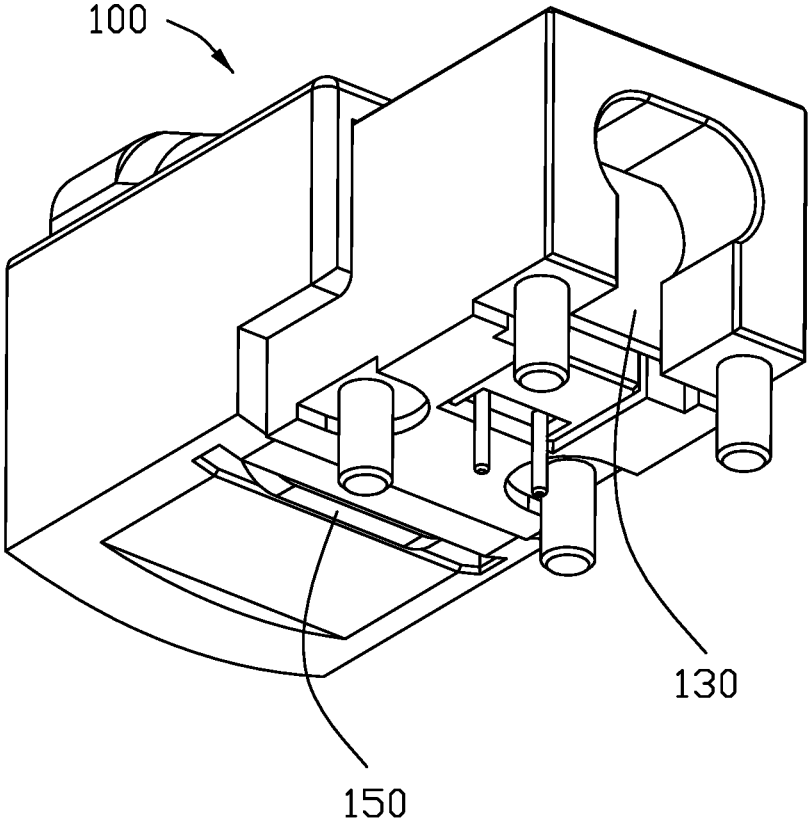
FIG. 21 is another perspective view of the receptacle connector of the connector assembly of FIG. 20.
Figure 22:
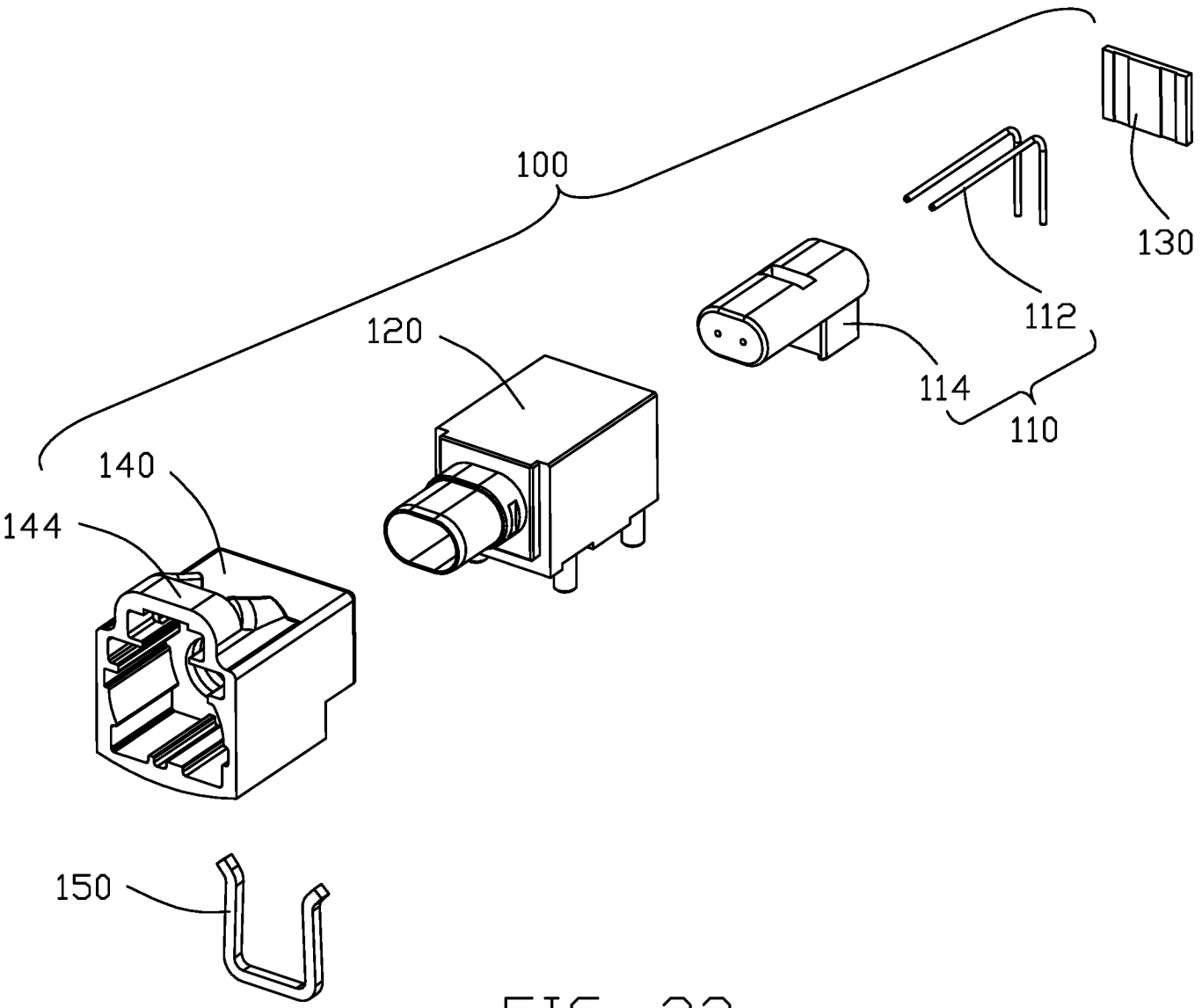
FIG. 22 is an exploded perspective view of the receptacle connector of the connector assembly of FIG. 20.
Figure 23:
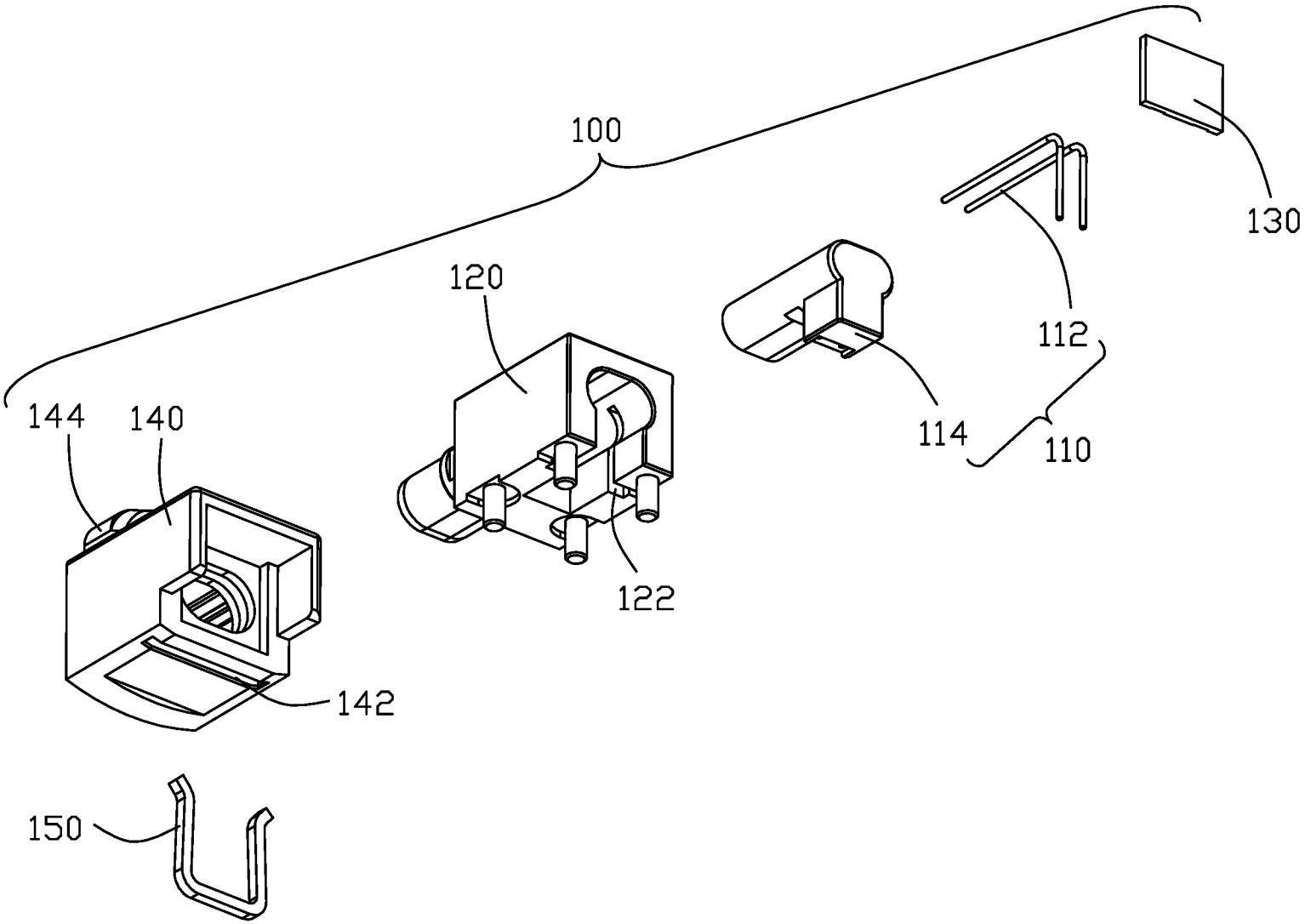
FIG. 23 is another explode perspective view of the receptacle connector of the connector assembly of FIG. 22.

Referring to FIGS. 1-23, a connector assembly 10 includes a receptacle connector 100 for mounting to a printed circuit board 500, and a plug connector 200 adapted to be mated with each other. Referring to FIGS. 20-23, the receptacle connector 100 includes a contact module 110 composed of a pair of male contacts 112 integrally formed within an insulator 114. The contact module 110 is assembled into the metallic housing 120 and retained therein by a rear cover 130 inserted into a slit 122 defined on the metallic housing 120. The metallic housing 120 is further assembled into an insulative shell 140 and retained therein by a clip 150 upwardly inserted into the groove 142. The clip 150 is U-shaped. The shell 140 unitarily forms a locking stand 144.

The plug connector 200 includes a contact module 210 composed of an insulative housing 212 and a pair of female contacts 214 therein. A metallic shell sub-assembly 220 encloses the insulative housing 212 and includes a front shell 222 and a rear shell 224. A cable 230 includes a pair of wires 232 electrically and mechanically connected to the female contacts 214. The rear end of the rear shell 224 grips the cable 230. An insulative outer cover 240 encloses the shell sub-assembly 220 and the associated contact module 210. A deflectable latch 242 in a cantilever arm with a locking hook 241 and an immoveable protection bridge 244 behind the locking hook 241 of the latch 242 are unitarily formed on the outer cover 240 wherein the free end region 243 of the latch 242 is downwardly restrained by the bridge 244.

A CPA (connector position assurance) 250 is discrete from while associated with and moveable relative to the outer cover 240. The CPA 250 includes a base 252 for retaining the CPA 250 within the outer cover 240 and an upper bar 254 located under a free end region 243 of the latch 242 for preventing downward deflection of the latch 242. The base 252 includes a downwardly deflectable center/engagement arm 256 with engagement protrusions 258 for retaining the CPA 250 in either a front blocked position or a rear releasing position with regard to the deflectable latch 242, and a pair of sidewardly deflectable side/engagement arms 260 with engagement protrusions 262 for retaining the CPA 250 in either the front blocked position or the rear releasing position with regard to the deflectable latch 242. The CPA 250 further includes an upstanding operation tab 259. In this embodiment, the pair of side/engagement arms 260 are received within the corresponding channels 270 in the outer cover 240 so as to have the CPA 250 retained to the outer cover 240 in a moveable manner along the front-to-back direction. Understandably, when the receptacle connector 100 and the plug connector 200 are mated with each other and the CPA 250 is located at the front blocked position, the latch 242 can not be downwardly deflected due to blocked between the upper bar 254 and the free end region 243 so that the locking hook 241 of the latch 242 will be reliably locked to the locking stand 144. In opposite, when the plug connector 200 is intended to be removed away from the receptacle connector 100, the CPA 250 is intentionally moved from the front blocked position to the rear releasing position to have the upper bar 254 disengaged from the free end region 243 of the latch 242, so that the locking hook 241 of the latch 242 is permitted to be downwardly deflected to be disengaged/unlocked from the locking stand 144. Notably, the outer cover 240 includes a plurality of recesses/openings 249 to receive the corresponding engagement protrusions 258, 262.

In this embodiment, the outer cover 240 defines a pair of recesses 249 in the upper surface of the outer cover 240. The pair of recesses 249 are spaced from each other in the front-to-back direction. Each channel 270 defines a pair of openings 249 extending through in a transverse direction perpendicular to both the front-to-back direction and the vertical direction. The pair of the openings 249 are spaced from each other in the front-to-back direction. The center arm 256 is vertical deflectable and the side arms 260 are lateral deflectable to cooperate to the outer cover 240.

In this embodiment, the upper bar 254 and the base 252 are parallel to each other in the vertical direction. The operation tab 259 is connected to the rear end of the upper bar 254 and the rear end of the base 252. A rid 255 is connected between the operation tab 259 and the upper bar 254. In the view of the vertical direction, the center arm 256 is T-shaped, and the pair of the side arms 260 are L-shaped. The pair of the side arms 260 encloses the center arm 256 in the front-to-back and the transverse direction. The side arms 260 and the center arm 256 are located at same level in the vertical direction, but the thickness of the side arms 260 and the center arm 256 are different in the vertical direction.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A connector assembly comprising:

a receptacle connector including:

a receptacle contact module having a pair of male contacts retained in an insulator;

a metallic housing enclosing the contact module;

an insulative shell enclosing the metallic housing with a locking stand thereon; and a plug connector adapted to be mated with the receptacle connector in a front-to-back direction and including:

a plug contact module having a pair of female contacts retained in an insulative housing;

a metallic shell sub-assembly enclosing the insulative housing;

an insulative outer cover enclosing the metallic shell sub-assembly and unitarily including a deflectable latch which is moveable in a vertical direction perpendicular to the front-to-back direction, with thereon a locking hook engageable with the locking stand during mating, and an immovable protection bridge located behind the locking hook to confront a free end region of the latch for restraining outward excessive deflection in the vertical direction;

wherein the outer cover further includes a discrete CPA (connector position assurance) moveable along the front-to-back direction between a front blocked position and a rear releasing position;

wherein the CPA includes a deflectable base and an upper bar spaced from the base in the vertical direction, the upper bar abuts against the free end region of the latch to prevent the latch from being deflected in the vertical direction when the CPA is located in the front blocked position;

wherein the base includes a pair of laterally deflectable side arms and a vertically deflectable center arm located between the pair of side arms and each of the side arms and the center arm has an engagement protrusion to retain the CPA in either the front blocked position or the rear releasing position.

2. The connector assembly as claimed in claim 1, wherein each side arm is L-shaped in a view of the vertical direction, and the pair of side arms enclose the center arm.

3. The connector assembly as claimed in claim 2, wherein the center arm is T-shaped in a view of the vertical direction.

4. The connector assembly as claimed in claim 1, wherein the CPA further includes an operation tab extending upwardly in the vertical direction and connecting the rear end of the upper bar and the rear end of the base.

5. The connector assembly as claimed in claim 4, wherein a rib connects between the upper bar and the operation tab.

6. The connector assembly as claimed in claim 1, wherein the outer cover forms a pair of channels to retain the CPA therein and to receive the pair of laterally deflectable side arms, respectively.

7. A plug connector comprising:

an insulative housing retained a pair of female contacts therein;

a metallic shell sub-assembly enclosing the insulative housing;

an insulative outer cover enclosing the shell sub-assembly;

a deflectable latch unitarily formed on the outer cover and moveable in a vertical direction;

an immovable protection bridge unitarily formed on the outer cover and locating around a free end region of the latch for inward restricting the latch in the vertical direction; and a moveable CPA (Connector Position Assurance) discrete from while associated with and moveable along the outer cover along a front-to-back direction perpendicular to the vertical direction between a front blocked position and a rear releasing position;

wherein the CPA includes a supporting portion intimately confronting the free end region of the latch in the vertical direction when the CPA is located in the front blocked position;

wherein the CPA includes a pair of laterally deflectable side arms and a vertically deflectable center arm located between the pair of side arms and each of the side arms and the center arm has an engagement protrusion to retain the CPA in either the front blocked position or the rear releasing position.

8. The plug connector as claimed in claim 7, wherein the outer cover forms a pair of channels to retain the CPA therein and to receive the pair of laterally deflectable side arms, respectively.

* * * * *